US010114333B2

(12) United States Patent
Miyakoshi

(10) Patent No.: US 10,114,333 B2
(45) Date of Patent: Oct. 30, 2018

(54) UNIT ATTACHMENT-DETACHMENT MECHANISM AND IMAGE FORMING APPARATUS THEREWITH

(71) Applicant: KYOCERA Document Solutions Inc., Osaka (JP)

(72) Inventor: Naoto Miyakoshi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 29 days.

(21) Appl. No.: 15/499,330

(22) Filed: Apr. 27, 2017

(65) Prior Publication Data

US 2017/0315500 A1 Nov. 2, 2017

(30) Foreign Application Priority Data

Apr. 28, 2016 (JP) ..... 2016-090872

(51) Int. Cl.
*G03G 21/16* (2006.01)

(52) U.S. Cl.
CPC ..... *G03G 21/1647* (2013.01); *G03G 21/1623* (2013.01); *G03G 21/168* (2013.01); *G03G 21/1671* (2013.01); *G03G 21/1676* (2013.01); *G03G 21/1685* (2013.01); *G03G 2221/1684* (2013.01)

(58) Field of Classification Search
CPC ..... G03G 21/1647; G03G 21/1842; G03G 15/1615; G03G 2215/0132; G03G 2221/1684
See application file for complete search history.

(56) References Cited

U.S. PATENT DOCUMENTS 6,130,817 A * 10/2000 Flotho ..... G11B 33/128 248/200
2012/0189409 A1* 7/2012 Toebes ..... B65G 1/0492 414/273
2012/0275820 A1 11/2012 Eto ..... 399/110
2014/0086627 A1* 3/2014 Tanabe ..... G03G 21/185 399/111

FOREIGN PATENT DOCUMENTS

JP 2012-230280 A 11/2012

* cited by examiner

*Primary Examiner* — Walter L Lindsay, Jr.
*Assistant Examiner* — Jessica L Eley
(74) *Attorney, Agent, or Firm* — Stein IP, LLC

(57) ABSTRACT

A unit attachment-detachment mechanism includes a unit and a pair of guide rails. The pair of guide rails slidably supports a pair of side faces of the unit. The side faces respectively have formed thereon engagement projections that engage with the guide rails. The pair of guide rails has formed therein at least a pair of inclined portions. The pair of inclined portions is formed asymmetrically with each other in the unit width direction perpendicular to the attachment-detachment direction.

6 Claims, 6 Drawing Sheets

UNIT ATTACHMENT-DETACHMENT MECHANISM AND IMAGE FORMING APPARATUS THEREWITH

INCORPORATION BY REFERENCE

This application is based upon and claims the benefit of priority from the corresponding Japanese Patent Application No. 2016-090872 filed on Apr. 28, 2016, the entire contents of which are incorporated herein by reference.

BACKGROUND

The present disclosure relates to a unit attachment-detachment mechanism including a unit attachable to and detachable from an apparatus main body and a pair of guide rails slidably supporting the unit, and also relates to an image forming apparatus incorporating such a unit attachment-detachment mechanism.

Conventionally, in an image forming apparatus relying on an electrophotographic process, a fixing unit, a drum unit, a developing unit, an intermediary transfer unit, and the like are fixed with screws in predetermined positions inside the image forming apparatus. On the other hand, when a sheet that has stuck (a jam) is dealt with, those units need to be taken out of the main body of the image forming apparatus. Also, if any unit has a service life shorter than that of the image forming apparatus, it needs to be replaced regularly.

With the conventional configuration mentioned above, every time a unit needs to replaced or a stuck sheet (a jam) needs to be dealt with, a serviceperson has to be sent for, resulting in low efficiency. On the other hand, for a non-professional user, attaching or detaching a unit using tools is a great burden. Against this background, there have been proposed methods that allow a user easy replacement of units, and according to a widely adopted configuration, a unit is inserted and pulled out along a guide shape provided in the main body of an image forming apparatus.

For example, in one known image forming apparatus, there are provided an intermediary transfer unit and a pair of guide rails that slidably supports engagement projections on side faces of the intermediary transfer unit. The intermediary transfer unit, when attached to the apparatus main body, has to be in contact with a drum unit but, in the middle of being attached or detached, has to be out of contact with the drum unit, a developing unit, and the like. Thus, to permit the intermediary transfer unit to move in the up-down direction (in the direction away from the drum unit), the guide rails have inclined portions.

SUMMARY

According to one aspect of the present disclosure, a unit attachment-detachment mechanism includes a unit and a pair of guide rails. The unit is attachable to and detachable from an apparatus main body in the horizontal direction. The pair of guide rails is provided on the apparatus main body, and slidably supports a pair of side faces of the unit that are parallel to the attachment-detachment direction of the unit. The side faces respectively have formed on them engagement projections that engage with the guide rails. The pair of guide rails has formed in them at least a pair of inclined portions along which the engagement projections move in the up-down direction. The pair of inclined portions is formed asymmetrically with each other in the unit width direction perpendicular to the attachment-detachment direction.

Further features and advantages of the present disclosure will become apparent from the description of embodiments given below.

DETAILED DESCRIPTION

Embodiments of the present disclosure will be described below with reference to the accompanying drawings.

First Embodiment

Figure 1:
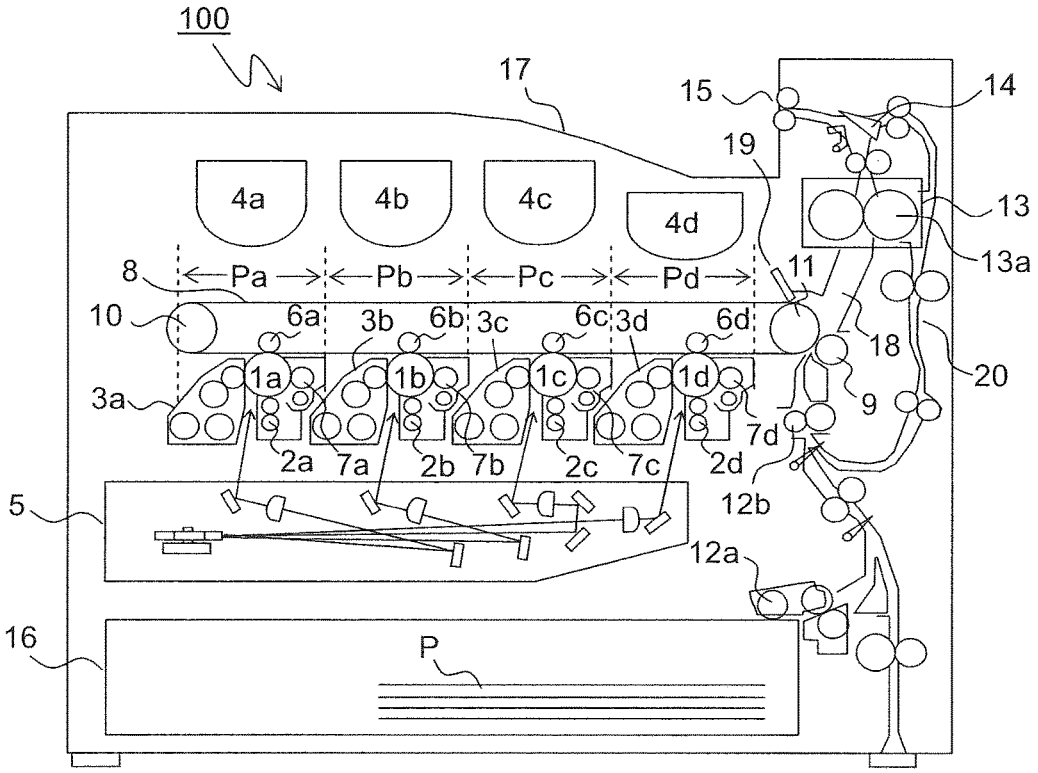
FIG. 1 is a schematic sectional view showing the structure of an image forming apparatus incorporating a unit attachment-detachment mechanism according to a first embodiment of the present disclosure.

FIG. 1 is a schematic sectional view showing the configuration of an image forming apparatus 100 incorporating a unit attachment-detachment mechanism 50 according to a first embodiment of the present disclosure, and depicts a tandem-type color image forming apparatus. Inside the main body of the image forming apparatus 100, four image forming sections Pa, Pb, Pc, and Pd are arranged in this order from the upstream side (in FIG. 1, the left side) in the conveying direction. These image forming sections Pa to Pd are provided to correspond to four different colors (cyan, magenta, yellow, and black), and form cyan, magenta, yellow, and black images successively each through the processes of charging, exposure, development, and transfer.

In these image forming sections Pa to Pd, photosensitive drums 1*a*, 1*b*, 1*c*, and 1*d* that carry visible images (toner images) of the different colors are arranged, and an intermediary transfer belt 8 that rotates counter-clockwise in FIG. 1 by being driven by a driving means (unillustrated) is provided next to the these image forming sections Pa to Pd. The toner images formed on these photosensitive drums 1*a* to 1*d* are successively transferred to the intermediary transfer belt 8, which moves while in contact with the photosensitive drums 1*a* to 1*d*, so as to be superimposed on each other, and are then transferred, by the action of a secondary transfer roller 9, to a transfer sheet P as one example of a recording medium, and are then fixed to the transfer sheet P in a fixing unit 13, the sheet then being discharged out of the apparatus main body. While the photosensitive drums 1*a* to 1*d* are rotated clockwise in FIG. 1, an image forming process is performed with respect to the photosensitive drums 1*a* to 1*d*.

Transfer sheets P to which toner images are to be transferred are stored in a sheet cassette 16 in a lower part of the apparatus, and are transferred, via a sheet feed roller 12*a* and a pair of registration rollers 12*b*, to a nip portion between the secondary transfer roller 9 and a driving roller 11, which will be described later, of the intermediary transfer belt 8. For the intermediary transfer belt 8, a sheet of a dielectric resin is used, which typically is a belt with no seam (a seamless belt). On the downstream side of the secondary transfer roller 9, a blade-form belt cleaner 19 for removing the toner that is left behind on the surface of the intermediary transfer belt 8 is arranged.

Next, the image forming sections Pa to Pd will be described. Around and under the photosensitive drums 1*a* to 1*d*, which are rotatably arranged, there are provided chargers 2*a*, 2*b*, 2*c*, and 2*d* for electrostatically charging the photosensitive drums 1*a* to 1*d*, an exposure device 5 for exposing the photosensitive drums 1*a* to 1*d* to light of image information, developing devices 3*a*, 3*b*, 3*c*, and 3*d* for forming toner images on the photosensitive drums 1*a* to 1*d*, and cleaning devices 7*a*, 7*b*, 7*c*, and 7*d* for removing the developer (toner) that is left behind on the photosensitive drums 1*a* to 1*d*.

When image data is entered from a host device such as a personal computer, first, by the chargers 2*a* to 2*d*, the surfaces of the photosensitive drums 1*a* to 1*d* are electrostatically charged uniformly, and then by the exposure device 5, light is radiated according to image data so that, on the photosensitive drums 1*a* to 1*d*, electrostatic latent images corresponding to the image data are formed. The developing devices 3*a* to 3*d* are charged with predetermined amounts of two-component toner containing toner of different colors, namely cyan, magenta, yellow, and black, respectively. When the proportion of the toner in the two-component developer contained in the developing devices 3*a* to 3*d* falls below a prescribed value, toner is supplied from toner containers 4*a* to 4*d* to the developing devices 3*a* to 3*d*. The toner in the developer is fed onto the photosensitive drums 1*a* to 1*d* by the developing devices 3*a* to 3*d* and, by electrostatically attaching to them, forms the toner images corresponding to the electrostatic latent images formed by exposure to the light from the exposure device 5.

Then, by applying a predetermined transfer voltage to primary transfer rollers 6*a* to 6*d*, the cyan, magenta, yellow, and black toner images on the photosensitive drums 1*a* to 1*d* are primarily transferred to the intermediary transfer belt 8. These images of the four colors are formed in a predetermined positional relationship that is previously determined for the formation of a predetermined full-color image. Thereafter, the toner and the like that are left behind on the surfaces of the photosensitive drums 1*a* to 1*d* are removed by the cleaning devices 7*a* to 7*d* in preparation for the subsequent formation of new electrostatic latent images.

The intermediary transfer belt 8 is stretched between a driven roller 10, on the upstream side, and a driving roller 11, on the downstream side, and when the intermediary transfer belt 8 starts to rotate counter-clockwise as the driving roller 11 rotates by being driven by a driving motor (unillustrated), a transfer sheet P is conveyed, with predetermined timing, from the pair of registration rollers 12*b* to a nip portion (secondary transfer nip portion) between the driving roller 11 and the secondary transfer roller 9, the latter being provided next to the former, so that the full-color image on the intermediary transfer belt 8 is transferred to the transfer sheet P. The sheet P having the toner images transferred to it is conveyed through a sheet conveying passage 18 to the fixing unit 13.

The transfer sheet P conveyed to the fixing unit 13 is heated and pressed by a pair of fixing rollers 13*a*, so that the toner images are fixed to the surface of the transfer sheet P, forming the predetermined full-color image. The transfer sheet P having the full-color image formed on it is distributed between different conveying directions by a branch portion 14 which branches into a plurality of directions. When an image is formed on only one side of the sheet P, it is discharged as it is onto a discharge tray 17 by a discharge roller 15.

On the other hand, when an image is formed on each side of the sheet P, the sheet P having passed through the fixing unit 13 is first conveyed toward the discharge roller 15, and when the tail end of the sheet P has passed through the branch portion 14, the discharge roller 15 is rotated reversely, and the conveying direction of the branch portion 14 is so switched that the sheet P is, starting with its tail end, distributed to a two-sided conveying passage 20, the sheet P then being conveyed once again, with the image side reversed, to the secondary transfer nip portion. Then, the next image formed on the intermediary transfer belt 8 is transferred by the secondary transfer roller 9 to the side of the sheet P on which no image has yet been formed, and the sheet P is then conveyed to the fixing unit 13, where the toner images are fixed, and is then discharged onto the discharge tray 17.

Figure 2:
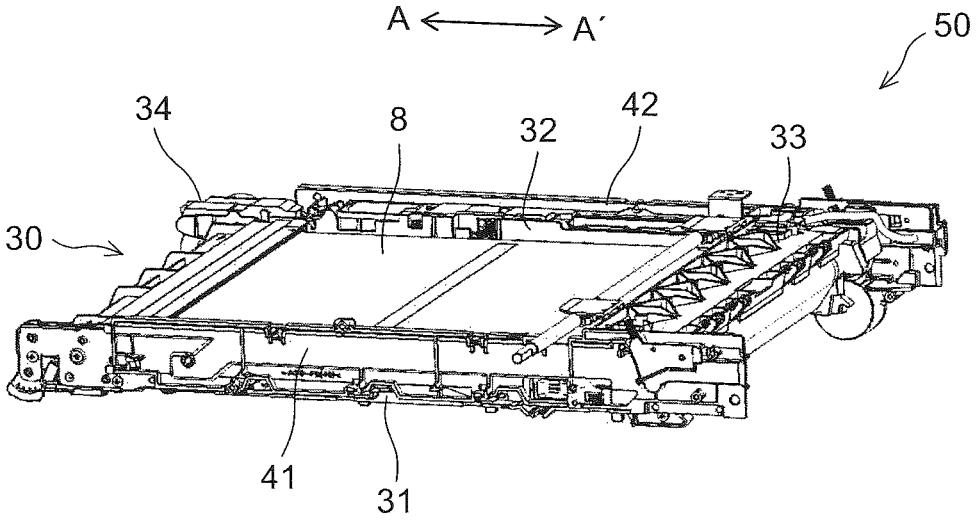
FIG. 2 is a perspective view showing the structure of the unit attachment-detachment mechanism according to the first embodiment of the present disclosure.
Figure 3:
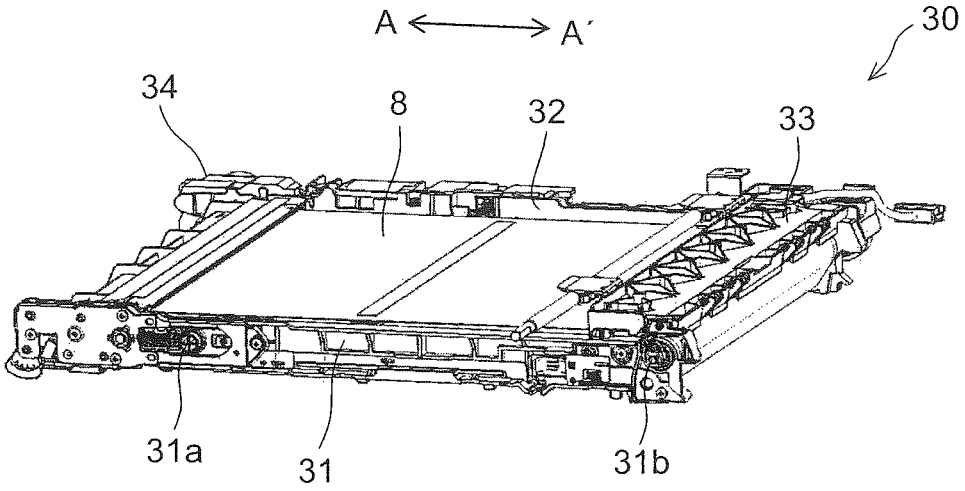
FIG. 3 is a perspective view showing the structure of an intermediary transfer unit in the unit attachment-detachment mechanism according to the first embodiment of the present disclosure.
Figure 4:
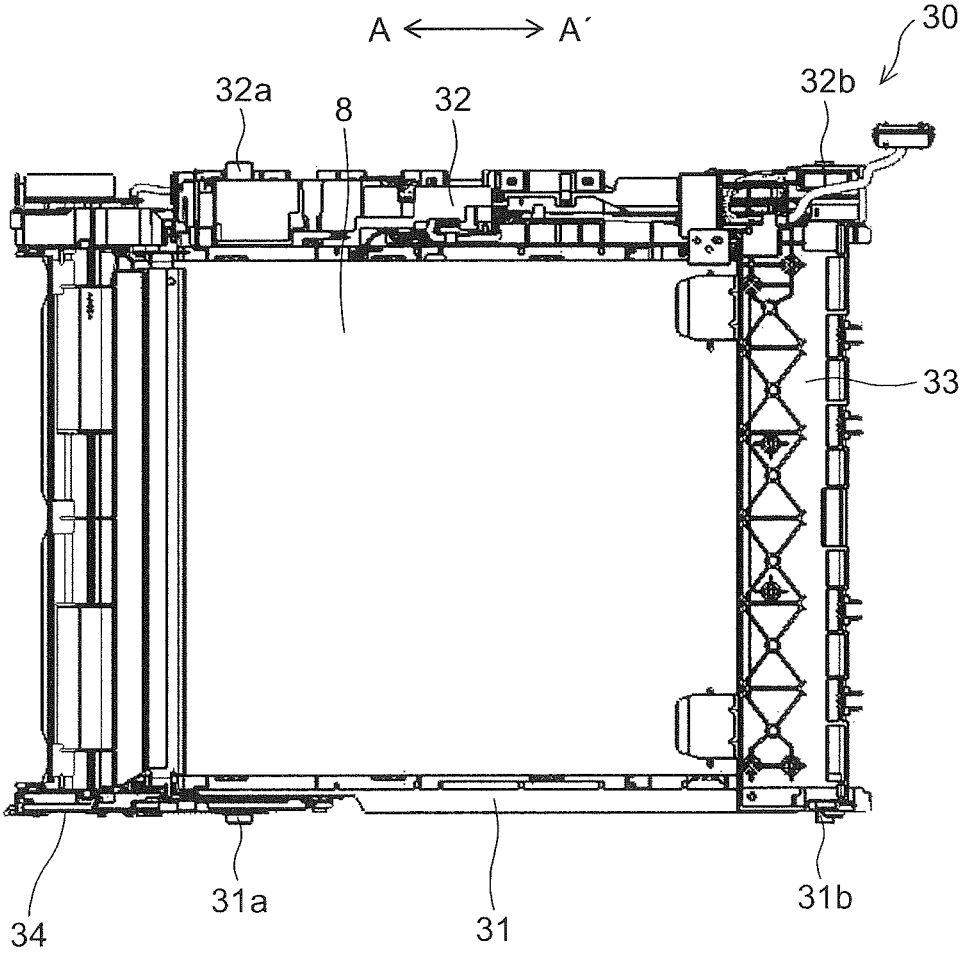
FIG. 4 is a plan view showing the structure of the intermediary transfer unit in the unit attachment-detachment mechanism according to the first embodiment of the present disclosure.
Figure 5:
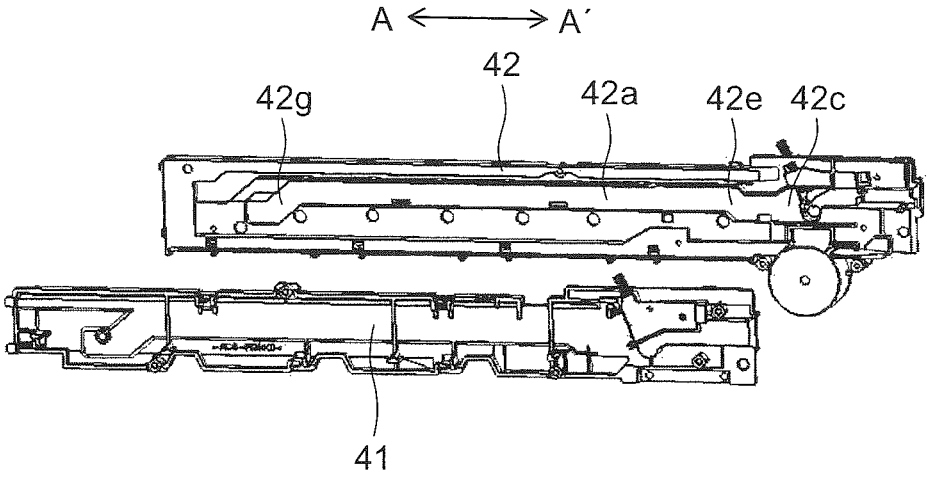
FIG. 5 is a perspective view showing the structure of a pair of support frames in the unit attachment-detachment mechanism according to the first embodiment of the present disclosure.

FIG. 2 is a perspective view showing the structure of the unit attachment-detachment mechanism 50 according to the first embodiment of the present disclosure, FIG. 3 is a perspective view showing the structure of an intermediary transfer unit 30 in the unit attachment-detachment mechanism 50 according to the first embodiment of the present disclosure, FIG. 4 is a plan view showing the structure of the intermediary transfer unit 30 in the unit attachment-detachment mechanism 50 according to the first embodiment of the present disclosure, and FIG. 5 is a perspective view showing the structure of a pair of support frames 41 and 42 in the unit attachment-detachment mechanism 50 according to the first embodiment of the present disclosure. FIGS. 2 and 3 are views seen from the far side of the plane of FIG. 1.

As shown in FIGS. 2 to 4, the intermediary transfer unit 30 is composed of a unit body 34 which is composed of two side frames (side faces) 31 and 32 and a top frame 33, primary transfer rollers 6*a* to 6*d*, the driven roller 10, and the driving roller 11 (for these, see FIG. 1) which are supported between the side frames 31 and 32, the endless intermediary transfer belt 8 which is stretched around those rollers, and the like.

On the side frames 31 and 32, there are provided first bosses 31*a* and 32*a* and second bosses 31*b* and 32*b* which are engagement projections that engage with a pair of support frames 41 and 42 (see FIGS. 2 and 5) which are provided in the main body of the image forming apparatus 100. The first bosses 31*a* and 32*a* are formed in the same size, and are arranged at the same position and at the same height in the attachment-detachment direction (the direction indicated by arrows AA') of the intermediary transfer unit 30. Likewise, the second bosses 31*b* and 32*b* are formed in the same size, and are arranged at the same position and at the same height in the attachment-detachment direction (the direction indicated by arrows AA', the horizontal direction) of the intermediary transfer unit 30. The intermediary transfer unit 30 and the pair of support frames 41 and 42 constitute the unit attachment-detachment mechanism 50. The pair of support frames 41 and 42 is supported so as to be attachable to and removable from the main body of the image forming apparatus 100.

Figure 6:
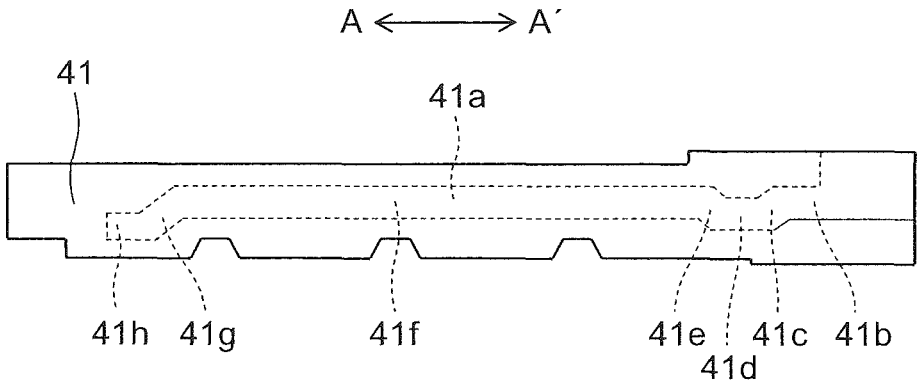
FIG. 6 is a diagram showing the structure of a support frame 41 in the unit attachment-detachment mechanism according to the first embodiment of the present disclosure.
Figure 7:
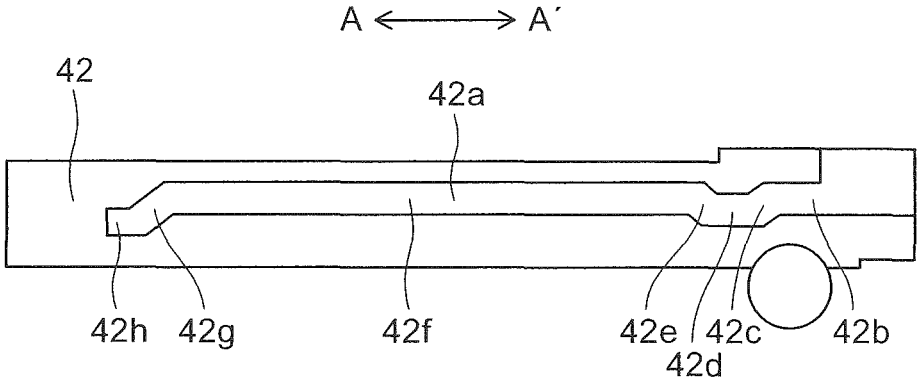
FIG. 7 is a diagram showing the structure of a support frame 42 in the unit attachment-detachment mechanism according to the first embodiment of the present disclosure.

As shown in FIGS. 6 and 7, on the pair of support frames 41 and 42, there is provided a pair of guide rails 41*a* and 42*a* which slidably support the first bosses 31*a* and 32*a* and the second bosses 31*b* and 32*b* on the intermediary transfer unit 30. The guide rails 41*a* and 42*a* are formed in the shape of grooves that hold the first bosses 31*a* and 32*a* and the second bosses 31*b* and 32*b* from above and below so as to restrict their movement in the up-down direction.

In the guide rails 41*a* and 42*a*, there are provided, from the upstream side (in the direction indicated by arrow A') of the attachment direction of the intermediary transfer unit 30, first flat portions 41*b* and 42*b*, first inclined portions 41*c* and 42*c*, second flat portions 41*d* and 42*d*, second inclined portions 41*e* and 42*e*, third flat portions 41*f* and 42*f*, third inclined portions 41*g* and 42*g*, and fourth flat portions 41*h* and 42*h*.

The first flat portions 41*b* and 42*b* are open on the upstream side (in the direction indicated by arrow A') in the unit attachment direction and on the top side so as to receive the first bosses 31*a* and 32*a* and the second bosses 31*b* and 32*b* easily. The first inclined portions 41*c* and 42*c* are arranged in a part of the guide rails 41*a* and 42*a* on the upstream side in the unit attachment direction, and are inclined downward toward the downstream side (in the direction indicated by arrow A) of the unit attachment direction. The second flat portions 41*d* and 42*d* are arranged lower than the first flat portions 41*b* and 42*b* and the third flat portions 41*f* and 42*f*. The second inclined portions 41*e* and 42*e* are arranged in a part of the guide rails 41*a* and 42*a* on the upstream side of the unit attachment direction, and are inclined upward toward the upstream side of the unit attachment direction. The third flat portions 41*f* and 42*f* are arranged at the same height as the first flat portions 41*b* and 42*b*. The third inclined portions 41*g* and 42*g* are arranged at an end part of the guide rails 41*a* and 42*a* on the downstream side in the unit attachment direction, and are inclined downward toward the downstream side in the unit attachment direction. The fourth flat portions 41*h* and 42*h* are arranged lower than the second flat portions 41*d* and 42*d*.

Here, the first inclined portions 41*c* and 42*c* are formed asymmetrically with each other in the unit width direction (the up-down direction in FIG. 4) perpendicular to the unit attachment-detachment direction, so are the second inclined portions 41*e* and 42*e*, and so are the third inclined portions 41*g* and 42*g*.

Figure 8:
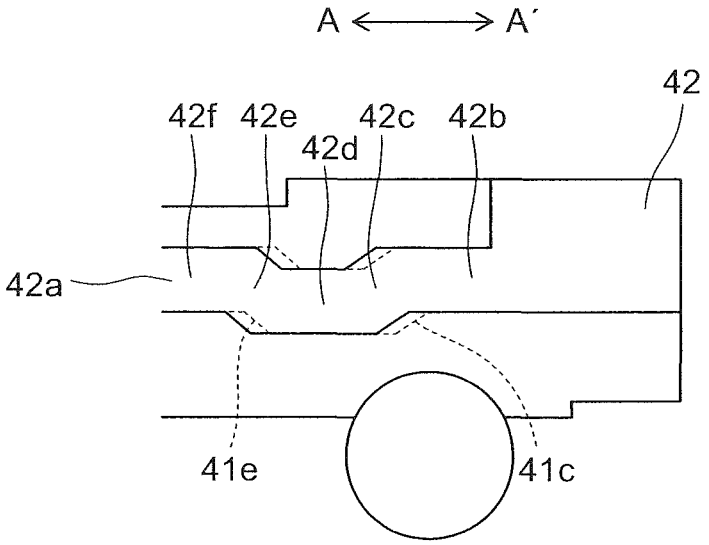
FIG. 8 is a diagram showing the structure of the support frame 42 in the unit attachment-detachment mechanism according to the first embodiment of the present disclosure as seen from the near side of the plane of FIG. 5, with first and second inclined portions in the support frame 41 superimposed.
Figure 9:
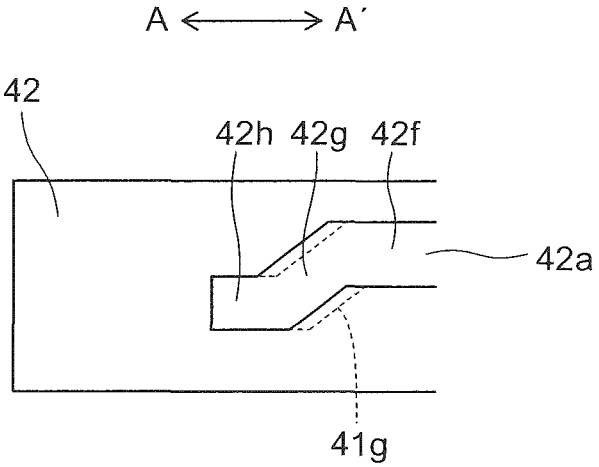
FIG. 9 is a diagram showing the structure of the support frame 42 in the unit attachment-detachment mechanism according to the first embodiment of the present disclosure as seen from the near side of the plane of FIG. 5, with third inclined portions in the support frame 41 superimposed.

In this embodiment, the first inclined portions 41*c* and 42*c* are arranged at mutually different positions in the unit attachment-detachment direction (the direction indicated by arrows AA'), so are the second inclined portions 41*e* and 42*e*, and so are the third inclined portions 41*g* and 42*g*. Specifically, as shown in FIG. 8, the first inclined portion 41*c* is arranged with a displacement of about several millimeters to the upstream side (in the direction indicated by arrow A') in the unit attachment direction relative to the first inclined portion 42*c*. Likewise, the second inclined portion 41*e* is arranged with a displacement of about several millimeters to the upstream side (in the direction indicated by arrow A') in the unit attachment direction relative to the second inclined portion 42*e*, and, as shown in FIG. 9, the third inclined portion 41*g* is arranged with a displacement of about several millimeters to the upstream side (in the direction indicated by arrow A') in the unit attachment direction relative to the third inclined portion 42*g*.

When the intermediary transfer unit 30 is attached to the main body of the image forming apparatus 100, the first bosses 31*a* and 32*a* on the intermediary transfer unit 30 pass through the first flat portions 41*b* and 42*b*, the first inclined portions 41*c* and 42*c*, the second flat portions 41*d* and 42*d*, the second inclined portions 41*e* and 42*e*, and the third flat portions 41*f* and 42*f* of the guide rails 41*a* and 42*a* in the order named. Meanwhile, since the first inclined portion 41*c* is arranged on the upstream side (in the direction indicated by arrow A') in the unit attachment direction relative to the first inclined portion 42*c*, the first boss 31*a* moves downward with advanced timing relative to the first boss 32*a*. Thus, with the intermediary transfer unit 30 in a slightly twisted state, the first bosses 31*a* and 32*a* pass through the first inclined portions 41*c* and 42*c*. Since the second inclined portion 41*e* is arranged on the upstream side (in the direction indicated by arrow A') in the unit attachment direction relative to the second inclined portion 42*e*, the first boss 31*a* moves upward with advanced timing relative to the first boss 32*a*. Thus, with the intermediary transfer unit 30 in a slightly twisted state, the first bosses 31*a* and 32*a* pass through the second inclined portions 41*e* and 42*e*.

While the first bosses 31*a* and 32*a* are passing through the third flat portions 41*f* and 42*f*, the intermediary transfer belt 8 is located away from the photosensitive drums 1*a* to 1*d*. When the first bosses 31*a* and 32*a* reach an end part of the third flat portions 41*f* and 42*f* on the downstream side (in the direction indicated by arrow A) in the unit attachment-detachment direction, the second bosses 31*b* and 32*b* are located in the first flat portions 41*b* and 42*b*.

When the intermediary transfer unit 30 is pushed further in the attachment direction (the direction indicated by arrow A), the first bosses 31*a* and 32*a* pass through the third inclined portions 41*g* and 42*g*. Meanwhile, since the third inclined portion 41*g* is arranged on the upstream side (in the direction indicated by arrow A') in the unit attachment direction relative to the third inclined portion 42*g*, the first boss 31*a* moves downward with advanced timing relative to the first boss 32*a*. Thus, with the intermediary transfer unit 30 in a slightly twisted state, the first bosses 31*a* and 32*a* pass through the third inclined portions 41*g* and 42*g*.

When the first bosses 31*a* and 32*a* have passed through the third inclined portions 41*g* and 42*g* and reached the fourth flat portions 41*h* and 42*h*, the second bosses 31*b* and 32*b* are located in the first flat portions 41*b* and 42*b*. As the first bosses 31*a* and 32*a* move through the fourth flat portions 41*h* and 42*h* in the attachment direction (the direction indicated by arrow A), the second bosses 31*b* and 32*b* pass through the first inclined portions 41*c* and 42*c* and are located in the second flat portions 41*d* and 42*d*. Meanwhile, since the first inclined portion 41*c* is arranged on the upstream side (in the direction indicated by arrow A') in the unit attachment direction relative to the first inclined portion 42*c*, the second boss 31*b* moves downward with advanced timing relative to the second boss 32*b*. Thus, with the intermediary transfer unit 30 in a slightly twisted state, the second bosses 31*b* and 32*b* pass through the first inclined portions 41*c* and 42*c*.

When the first bosses 31*a* and 32*a* are located in the fourth flat portions 41*h* and 42*h*, and the second bosses 31*b* and 32*b* are located in the second flat portions 41*d* and 42*d*, the intermediary transfer belt 8 is kept in pressed contact with the photosensitive drums 1*a* to 1*d* under a predetermined force.

In the manner described above, the intermediary transfer unit 30 is attached to the main body of the image forming apparatus 100.

When the intermediary transfer unit 30 is pulled out of the main body of the image forming apparatus 100, the first bosses 31*a* and 32*a* and the second bosses 31*b* and 32*b* operate the other way around than described above.

In this embodiment, as described above, the first inclined portions 41*c* and 42*c* are formed asymmetrically with each other in the unit width direction. Likewise, the second inclined portions 41*e* and 42*e* are formed asymmetrically with each other in the unit width direction, and the third inclined portions 41*g* and 42*g* are formed asymmetrically with each other in the unit width direction. Thus, the intermediary transfer unit 30 is attached and detached while being twisted slightly, and this produces an adequate sliding load between the intermediary transfer unit 30 and the guide rails 41*a* and 42*a*. This prevents the first bosses 31*a* and 32*a* and the second bosses 31*b* and 32*b* on the intermediary transfer unit 30 from hitting vigorously the first inclined portions 41*c* and 42*c*, the second inclined portions 41*e* and 42*e*, and the third inclined portions 41*g* and 42*g* of the guide rails 41*a* and 42*a*, and it is thus possible to prevent breakage of the intermediary transfer unit 30 and the guide rails 41*a* and 42*a*, and to prevent loud impact noise.

A time lag between the near side (the guide rail 41*a* side) and the far side (the guide rail 42*a* side) of the apparatus can be introduced in the timing with which the first bosses 31*a* and 32*a* and the second bosses 31*b* and 32*b* hit the first inclined portions 41*c* and 42*c*, the second inclined portions 41*e* and 42*e*, and the third inclined portions 41*g* and 42*g*, and this helps prevent loud impact noise more effectively.

As described above, the first inclined portions 41*c* and 42*c* are arranged at mutually different positions in the unit attachment-detachment direction (the direction indicated by arrows AA'). Likewise, the second inclined portions 41*e* and 42*e* are arranged at mutually different positions in the unit attachment-detachment direction, and the third inclined portions 41*g* and 42*g* are arranged at mutually different positions in the unit attachment-detachment direction. Thus, a time lag between the near side and the far side of the apparatus can easily be introduced in the timing in which the first bosses 31*a* and 32*a* and the second bosses 31*b* and 32*b* move up and down, and this allows easy twisting of the intermediary transfer unit 30.

As described above, at least the third inclined portions 41*g* and 42*g* are formed asymmetrically with each other in the unit width direction. The intermediary transfer unit 30 tends to accelerate more easily when it is attached than when it is pulled out, and the first bosses 31*a* and 32*a* tend to hit vigorously the third inclined portions 41*g* and 42*g* in an end part of the guide rails 41*a* and 42*a* on the downstream side (in the direction indicated by arrow A) in the unit attachment direction. Thus, forming the third inclined portions 41*g* and 42*g*, which is provided in an end part of the guide rails 41*a* and 42*a* in the downstream side in the unit attachment direction, asymmetrically with each other is particularly effective.

Second Embodiment

Figure 10:
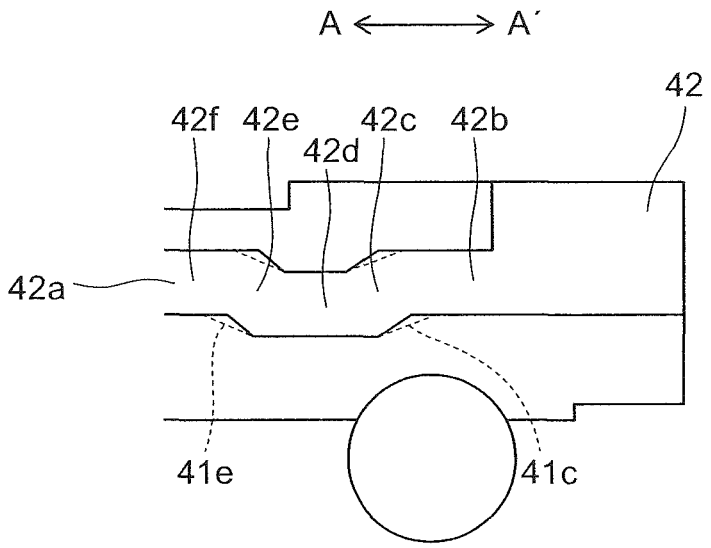
FIG. 10 is a diagram showing the structure of a support frame 42 in a unit attachment-detachment mechanism according to a second embodiment of the present disclosure as seen from the near side of the plane of FIG. 5, with first and second inclined portions in a support frame 41 superimposed.
Figure 11:
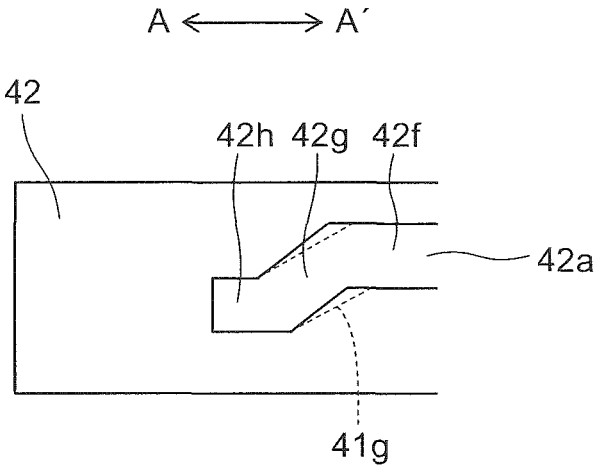
FIG. 11 is a diagram showing the structure of the support frame 42 in the unit attachment-detachment mechanism according to the second embodiment of the present disclosure as seen from the near side of the plane of FIG. 5, with third inclined portions in the support frame 41 superimposed.

In a second embodiment of the present disclosure, as shown in FIGS. 10 and 11, the first inclined portions 41*c* and 42*c* are formed with mutually different inclination angles, so are the second inclined portions 41*e* and 42*e*, and so are the third inclined portions 41*g* and 42*g*. Specifically, the first inclined portion 41*c* is formed with an inclination angle smaller than that of the first inclined portion 42*c*. Likewise, the second inclined portion 41*e* is formed with an inclination angle smaller than that of the second inclined portion 42*e*, and the third inclined portion 41*g* is formed with an inclination angle smaller than that of the third inclined portion 42*g*.

When the intermediary transfer unit 30 is attached to the main body of the image forming apparatus 100, since the first inclined portion 41*c* is formed with an inclination angle smaller than that of the first inclined portion 42*c*, the first boss 31*a* moves downward at lower speed than the first boss 32*a*. Thus, with the intermediary transfer unit 30 in a slightly twisted state, the first bosses 31*a* and 32*a* pass through the first inclined portions 41*c* and 42*c*. Since the second inclined portion 41*e* is formed with an inclination angle smaller than that of the second inclined portion 42*e*, the first boss 31*a* moves upward at lower speed than the first boss 32*a*. Thus, with the intermediary transfer unit 30 in a slightly twisted state, the first bosses 31*a* and 32*a* pass through the second inclined portions 41*e* and 42*e*.

Since the third inclined portion 41*g* is formed with an inclination angle smaller than that of the third inclined portion 42*g*, the first boss 31*a* moves downward at lower speed than the first boss 32*a*. Thus, with the intermediary transfer unit 30 in a slightly twisted state, the first bosses 31*a* and 32*a* pass through the third inclined portions 41*g* and 42*g*. Since the first inclined portion 41*c* is formed with an inclination angle smaller than that of the first inclined portion 42*c*, the second boss 31*b* moves downward at lower speed than the second boss 32*b*. Thus, with the intermediary transfer unit 30 in a slightly twisted state, the second bosses 31*b* and 32*b* pass through the first inclined portions 41*c* and 42*c*.

When the intermediary transfer unit 30 is pulled out of the main body of the image forming apparatus 100, the first bosses 31*a* and 32*a* and the second bosses 31*b* and 32*b* operate the other way around than described above.

In other respects in terms of structure and in terms of the operation for attaching and detaching the intermediary transfer unit 30, the second embodiment is similar to the first embodiment described previously.

In this embodiment, as described above, the first inclined portions 41*c* and 42*c* are formed with mutually different inclination angles. Likewise, the second inclined portions 41*e* and 42*e* are formed with mutually different inclination angles, and the third inclined portions 41*g* and 42*g* are formed with mutually different inclination angles. Thus, a difference between the near side and the far side of the apparatus can easily be introduced in the speed or timing with which the first bosses 31*a* and 32*a* and the second bosses 31*b* and 32*b* move up and down, and this allows easy twisting of the intermediary transfer unit 30.

In other respects in terms of benefits, the second embodiment is similar to the first embodiment described previously.

The embodiments disclosed herein should be understood to be in every respect illustrative and not restrictive. The scope of the present disclosure is not defined by the description of embodiments given above but by the appended claims, and encompasses any modifications made in the sense and scope equivalent to those of the claims.

For example, the above description deals with examples where the present disclosure is applied to a color printer, this is not meant to limit the application of the present disclosure. Needless to say, the present disclosure is applicable to a variety of image forming apparatuses, such as monochrome printers, color copiers, monochrome copiers, and facsimile machines, that incorporate a unit attachment-detachment mechanism including a unit and a guide rail.

Although the above embodiments deal with examples where an intermediary transfer unit is used as a unit that is attachable to and detachable from an apparatus main body, any unit other than an intermediary transfer unit (for example, a drum unit, a developing unit, or a fixing unit) may instead be used.

Although the above embodiments deal with examples where three pairs of inclination portions (the first inclined portions 41*c* and 42*c*, the second inclined portions 41*e* and 42*e*, and the third inclined portions 41*g* and 42*g*) are provided in the guide rails 41*a* and 42*a* and these three pairs of inclined portions each have inclined portions formed asymmetrically with each other in the unit width direction, this is not meant to limit the implementation of the present disclosure. At least one pair of inclined portions has to have inclined portions formed asymmetrically with each other in the unit width direction.

Although the above embodiments deal with examples where three pairs of inclination portions (the first inclined portions 41*c* and 42*c*, the second inclined portions 41*e* and 42*e*, and the third inclined portions 41*g* and 42*g*) are provided in the guide rails 41*a* and 42*a*, this is not meant to limit the implementation of the present disclosure. At least one pair of inclined portions has to be provided in the guide rails 41*a* and 42*a*.

Any combination of features from different ones of the embodiments and modified examples described above falls within the technical scope of the present disclosure.

What is claimed is:

1. A unit attachment-detachment mechanism, comprising, a unit attachable to and detachable from an apparatus main body in a horizontal direction; and a pair of guide frames provided on the apparatus main body and slidably supporting a pair of side faces of the unit parallel to an attachment-detachment direction of the unit and arranged respectively at both sides in a unit width direction perpendicular to the attachment-detachment direction, the pair of frames being arranged at a predetermined distance from each other in the unit width direction, wherein the pair of frames respectively include guide rails which slidably support the side faces of the unit, the side faces respectively have formed thereon engagement projections that engage with the guide rails, the pair of guide rails has formed therein at least a pair of inclined portions along which the engagement projections move in an up-down direction, and the pair of inclined portions is formed asymmetrically with each other in the unit width direction.

2. The unit attachment-detachment mechanism of claim 1, wherein the pair of inclined portions is arranged at mutually different positions in the attachment-detachment direction.

3. The unit attachment-detachment mechanism of claim 1, wherein the pair of inclined portions is formed with mutually different inclination angles.

4. The unit attachment-detachment mechanism of claim 1, wherein the pair of inclined portions is provided in an end part of the pair of guide rails on a downstream side in a unit attachment direction.

5. The unit attachment-detachment mechanism of claim 1, wherein the unit is an intermediary transfer unit having an intermediary transfer belt.

6. An image forming apparatus comprising the unit attachment-detachment mechanism of claim 1.

* * * * *